US005706767A

United States Patent [19]

Prevedello

[11] Patent Number: 5,706,767

[45] Date of Patent: Jan. 13, 1998

[54] MONOBLOC BOILER ESPECIALLY SUITABLE FOR HYDROCLEANING MACHINES

[75] Inventor: Alberto Prevedello, Vaiano Cremasco, Italy

[73] Assignee: Officine Meccaniche Faip S.r.1, Vaiano Cremasco, Italy

[21] Appl. No.: 526,636

[22] Filed: Sep. 11, 1995

[30] Foreign Application Priority Data

Sep. 27, 1994 [IT] Italy ..... MI94A1950

[51] Int. Cl.[6] ..... F22B 5/02

[52] U.S. Cl. ..... 122/190; 122/248

[58] Field of Search ..... 122/13.1, 17, 190, 122/245, 246, 247, 248, 250 R, 276, 275, 367.1

[56] References Cited

U.S. PATENT DOCUMENTS

| | | | |
|---|---|---|---|
| 2,645,210 | 7/1953 | Harris et al. | 122/248 |
| 3,060,905 | 10/1962 | Cunningham et al. | 122/248 |

FOREIGN PATENT DOCUMENTS

| | | | |
|---|---|---|---|
| 1083536 | 6/1960 | Germany | 122/250 R |
| 52-15902 | 2/1977 | Japan | 122/248 |
| 573576 | 1/1976 | Switzerland | 122/248 |
| 1511520 | 9/1989 | U.S.S.R. | 122/250 R |
| 792747 | 4/1958 | United Kingdom | 122/248 |

*Primary Examiner*—Noah P. Kamen
*Attorney, Agent, or Firm*—Bucknam and Archer

[57] ABSTRACT

A monobloc boiler particularly suitable for hydrocleaning machines, comprising a combustion chamber (6), the outer surface of which is wrapped by a double-coil pipe (8), wherein water to be heated flows; a cylinder wrapping up said chamber (6); a fuel mixing and ignition unit (4); flanges (5) for air distribution and braking in boiler body; a fan system (16) for air inlet in boiler body and an external box (12 wrapping and enclosing all these components. A fan system (16) is fixed on a first rear wall of the external box (12) and generates an air flow in an air gap (18) formed between the external box (12) and the cylinder (10). A mixing and ignition unit (4) is also located within boiler body and is fixed in the center on the other wall of the external box (12), opposite to the first rear wall.

9 Claims, 5 Drawing Sheets

MONOBLOC BOILER ESPECIALLY SUITABLE FOR HYDROCLEANING MACHINES

BACKGROUND OF THE INVENTION

1. Field of the Invention

This invention relates to a monobloc boiler particularly suitable for hydrocleaning machines.

More particularly, this invention relates to a boiler made of a single body which is arranged horizontally, suitable to be installed on fixed structures or wheeled carts.

2. Description of Prior Art

It is known that boilers for hydrocleaning machines comprise standard components, independently of the construction model, which include a combustion chamber, pipes wrapping the combustion chamber and an exhaust chimney.

In the combustion chamber, generally of parallelepidedal or cylindrical form, conventionally vertically arranged, the burning fuel is air-supported.

The walls of the combustion chamber are wrapped by horizontal pipes in which water flows. Water overheats in these pipes due to the heat generated in the combustion chamber and transmitted to pipes by radiation. Smoke caused by combustion generally exits from the top through a chimney and pre-heats in the pipes the water which is then transformed into steam. Water circulation in the pipes may be natural or forced, through circulation pumps.

In addition to the foregoing, the boilers are provided with fans for the forced flow of combustion air and smoke.

These features are common to almost all of the boilers which are being produced, with possible construction variations of minor importance.

The major drawbacks of all the known boilers especially are due to the yield and overall dimensions.

In particular, the yield in terms of calories is not entirely satisfactory because of heat loss outside the combustion chamber, both because of the smoke which comes out of the combustion chamber at a still high temperature, and because of the conduction dispersion through the boiler walls. Besides, the known boilers are arranged vertically to allow an acceptable combustion process in their interior. Another drawback of the known boilers are their overall dimensions. Actually the size of some components is due to the structure which circumscribes the combustion chamber.

During the installation, volumetric problems are generated which translate into a lower accessibility to the various components and affect production cost.

SUMMARY OF THE INVENTION

It is an object of this invention to obviate the aforementioned drawbacks.

In particular, it is an object of this invention to provide a boiler suitable for hydrocleaning machines having very contained overall dimensions.

It is another object of this invention to provide a boiler particularly suitable for hydrocleaning machines, capable of markedly reducing heat loss to the outside, which heat is instead used for heating the water.

It is still another object of this invention to provide a boiler particularly suitable for hydrocleaning machines, capable of providing high resistance and reliability in the long run.

It is still another object of this invention to provide a boiler having a monobloc structure constituting the bearing frame and suitable to be directly fixed to wheeled frames or carts in general.

It is yet another object of this invention to provide a monobloc boiler especially suitable for hydrocleaning machines, of easy and economical realization.

According to this invention, these and other objects are achieved through a monobloc boiler comprising an external cylindrical box having a first rear wall and a second wall opposite to the first one, the box including a cylindrical combustion chamber, on the outside of which a double-coil pipe is wrapped up, wherein water to be heated flows; a cylinder wrapping up said chamber; a fuel mixing and ignition unit fixed to the central part of the second wall of the box; a fan system for air inlet in the boiler body, fixed in the interior of the boiler body on the central part of the first rear wall of the external box and which generates an air flow in an air gap formed between said external box and the external cylinder, and distribution and braking means of air flow located radially with respect to the air gap and fixed to the inner wall of the box.

BRIEF DESCRIPTION OF DRAWINGS

The construction and functional characteristics of the boiler subject matter of this invention will be better understood thanks to the following description, wherein reference is made to the figures of the attached drawings which illustrate a preferred non-limiting embodiment, and wherein.

DESCRIPTION OF THE PREFERRED EMBODIMENT

With reference to the figures, the boiler of this invention, indicated globally by 1, comprises an external cylindrical box 12, provided with a top chimney 14 for the exit of combustion smoke.

Figure 1:
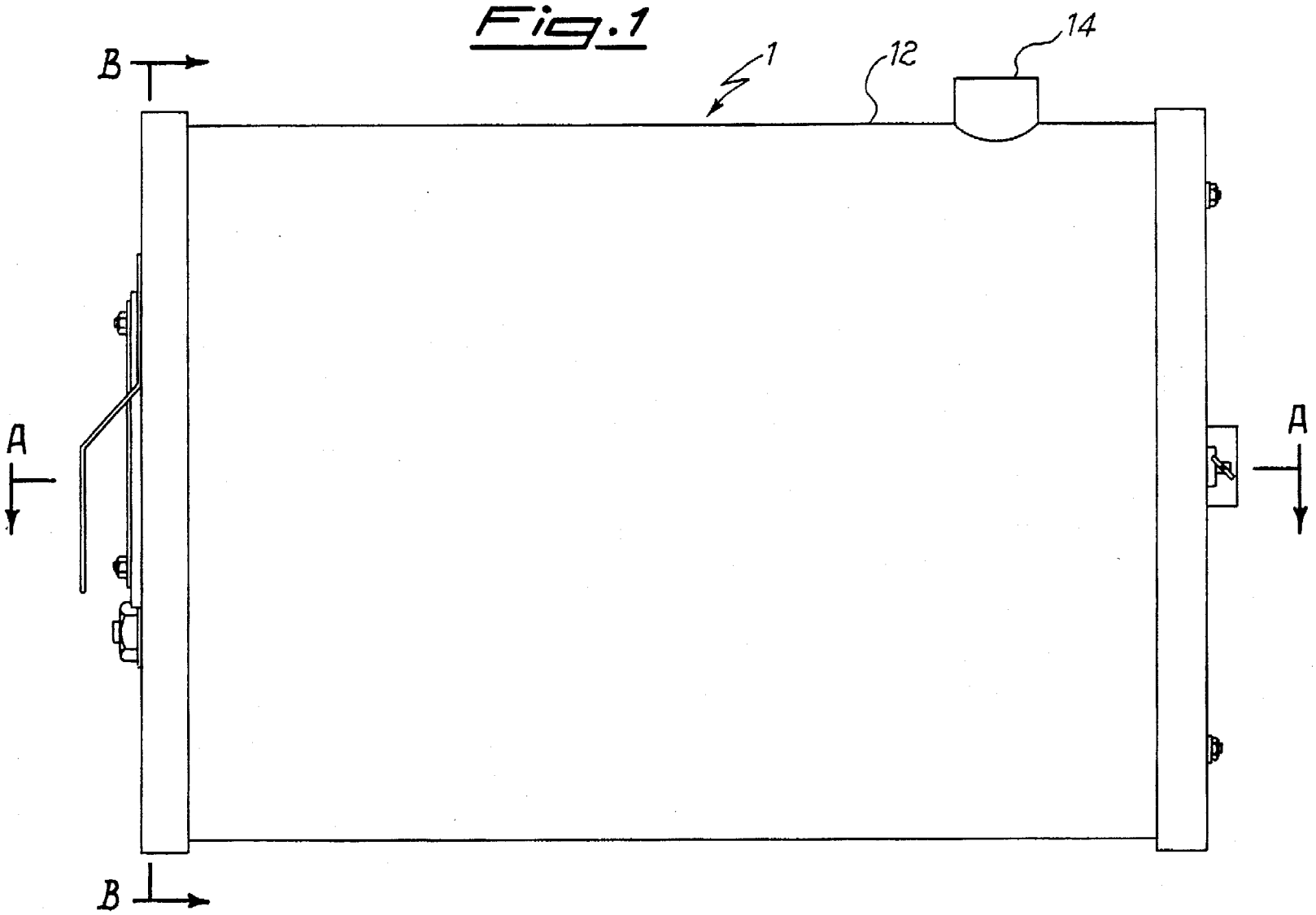
FIG. 1 is a schematic front view of the boiler of this invention.
Figure 2:
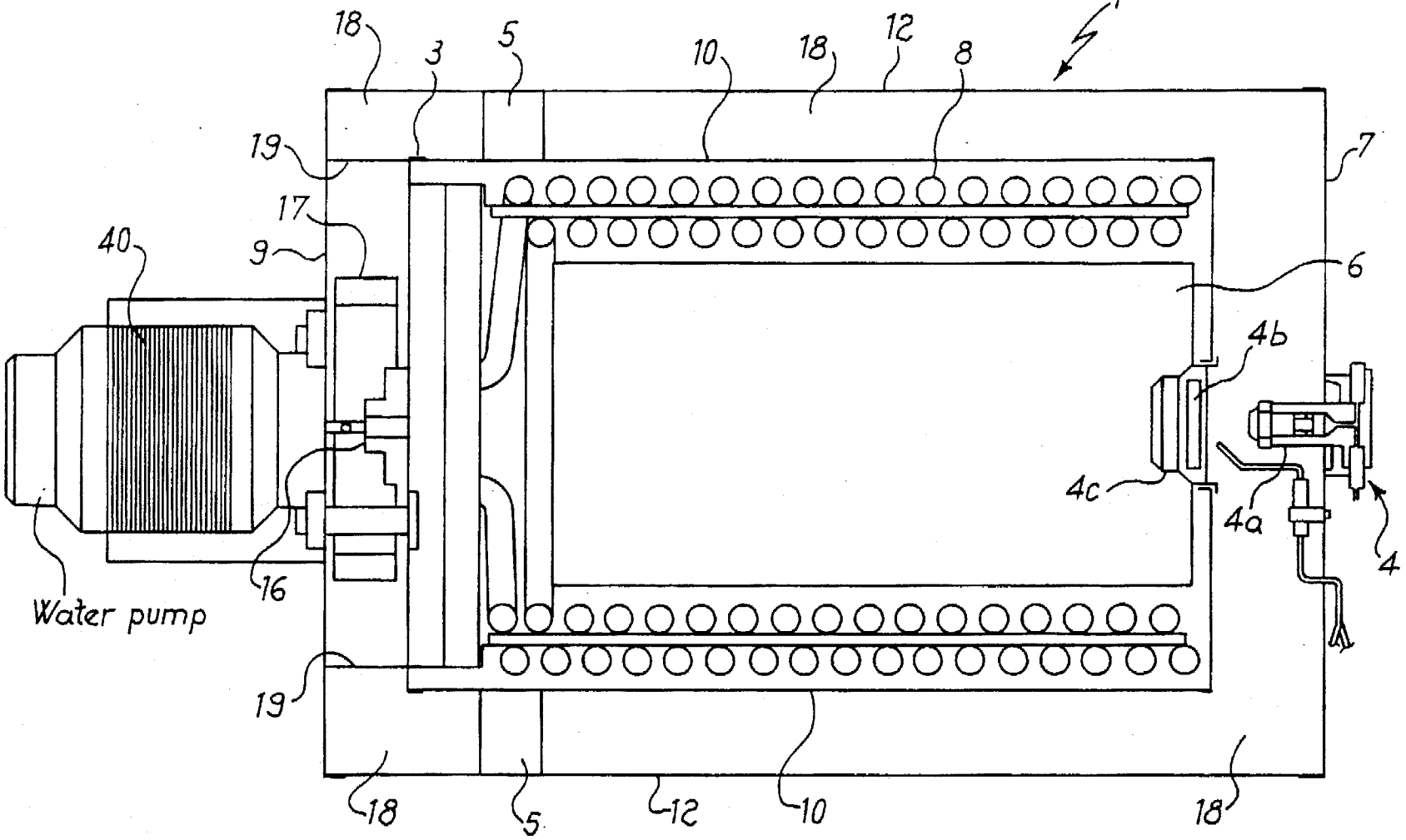
FIG. 2 is the schematic view of a through section of the boiler of FIG. 1, with a plane passing along the A—A line of FIG. 1.
Figure 5:
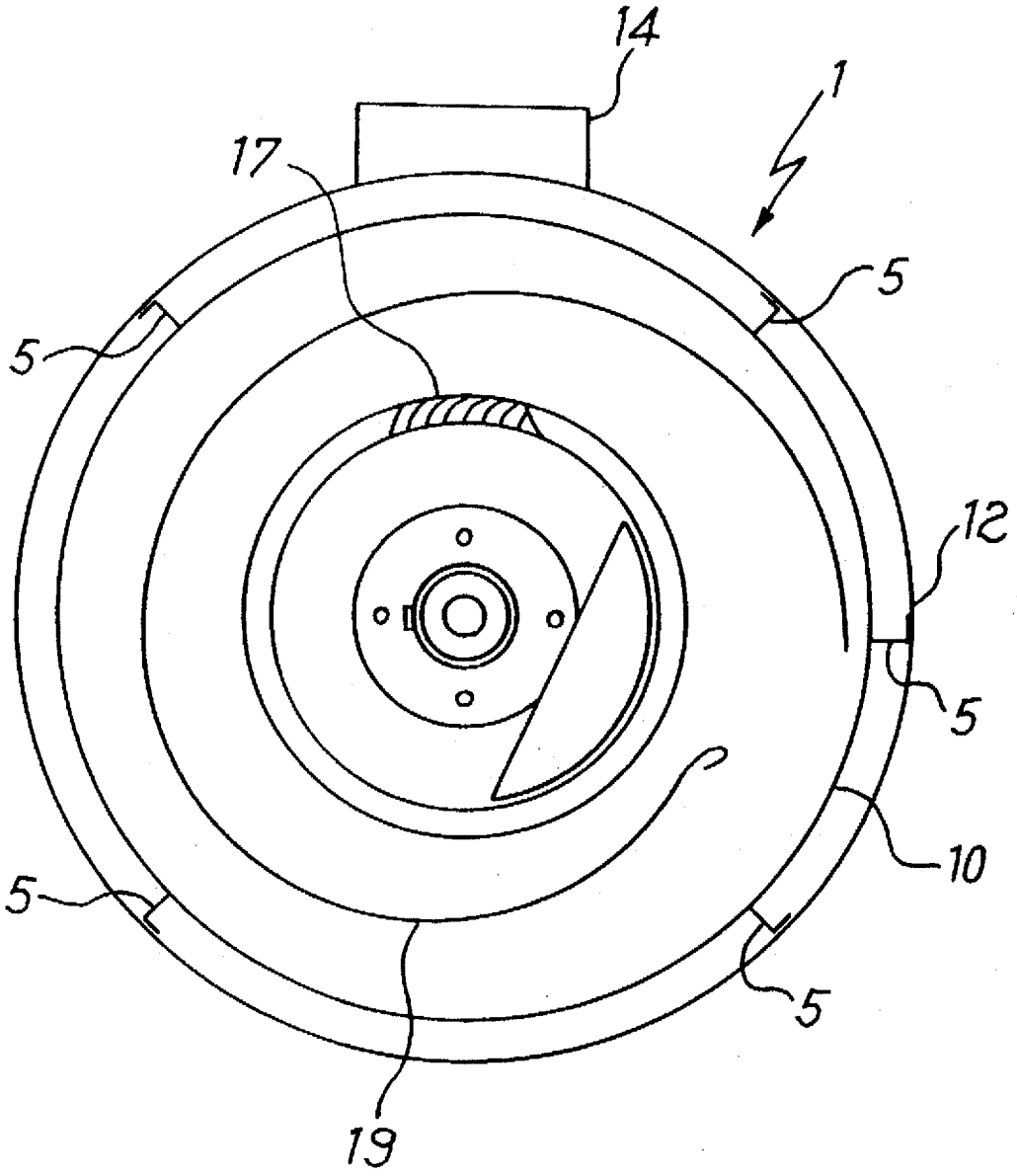
FIG. 5 is the schematic view of a through section of the boiler of the preceding figures, with a plane passing along the B—B line of FIG. 1.

FIG. 2 shows the arrangement of the main components of the boiler of this invention in the interior of the cylindrical box 12. The boiler 1 comprises a combustion chamber 6, preferably cylindrical, around which a double-coil pipe 8 is wrapped up. Water to be heated flows in the pipe which is in the interior of a cylinder 10 external to combustion chamber 6 and which wraps this chamber. The external cylinder 10 is closed at the bottom by a lid 3 integral with the cylinder. A mixing and ignition unit 4, means 5 for the distribution and braking of air flow in boiler body 1 shaped as L-shaped brackets (see FIG. 5), and a fan system 16 for the inlet of air in boiler body 1 are arranged in the interior of the cylindrical box 12. Cylindrical box 12 comprises a first rear wall 9 and a second wall 7 opposite to the rear wall 9.

According to this invention, the fan system 16 is fixed in the interior of the boiler body 1 on the central part of first rear wall 9 of the external box 12. The fan system 16 is constituted by a fan 17 for the inlet of air in boiler 6 and a scroll 19 distributing air in boiler 6 and a scroll 19 distributing air in an air gap 18 formed between the cylindrical box 12 and the external cylinder 10. The mixing and ignition unit 4, also located inside boiler body 1, is located in front of fan system 16 and is fixed in the center of the second wall 7 of box 12, opposite to rear wall 9, as described hereinbelow.

In particular, the mixing and ignition unit 4 comprises an injection nozzle 4*a*, connected to the wall 7 of external box 12, a mixing baffler 4*b* and a pipe union 4*c*, both of them fixed to the cylinder 10 external to combustion chamber 6.

In addition, between cylinder 10, external to combustion chamber 6, and cylindrical box 12 an air gap 18 is formed circumscribing the external surface of cylinder 10, for the air flow to combustion chamber 6. In this air gap 18, air of scroll 19 is distributed. The means for the distribution and braking of the air flow 5 are constituted by flanges radially arranged in air gap 18 and connected with known means to the inner wall of box 12. These flanges are hit by the air flow sucked by fan system 16 and cause an adequate braking of air flow and its distribution in air gap 18. These flanges are preferably constituted by 90° -bent sheet elements.

A motor-driven pump 40 activates air sucking fan 17 and forces water circulation in pipes 8.

Figure 3:
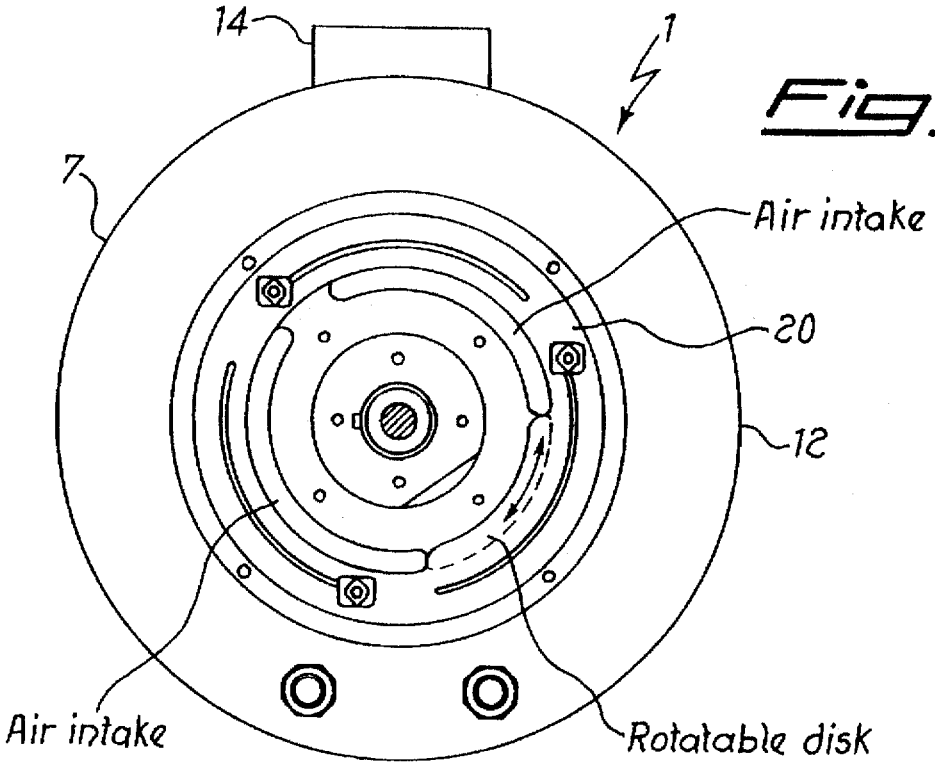
FIG. 3 is the schematic side view of the boiler of the preceding figures.
Figure 4:
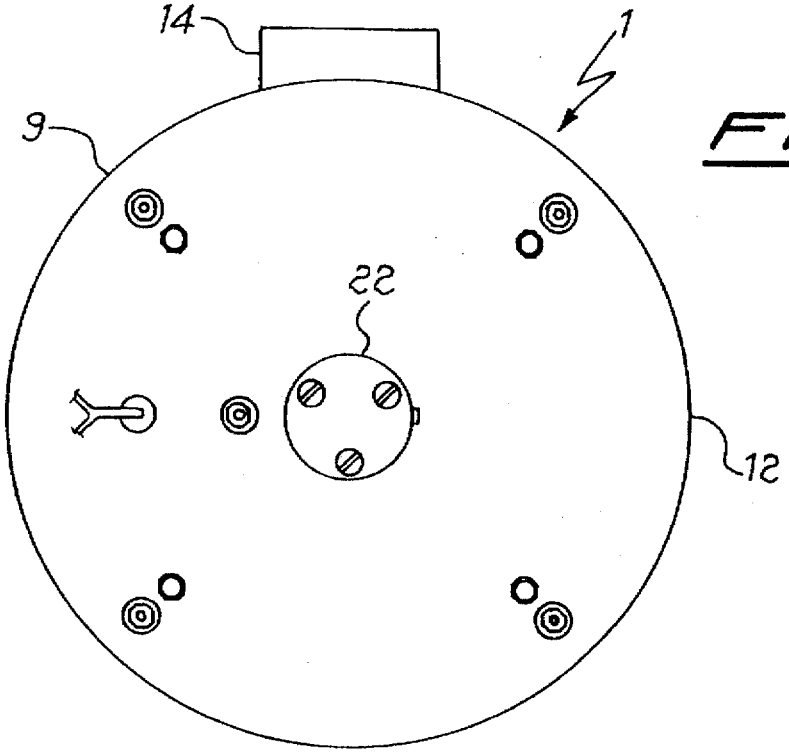
FIG. 4 is the schematic view of the side opposed to that of FIG. 3.

FIGS. 3 and 4 represent respectively the two opposite external walls 7, 9 of boiler body. They show the mechanisms for air circulation in the boiler. In particular, FIG. 3 shows the device for the air inlet which in the external part is advantageously provided with an angular diaphragm 20, which determines the quantity of air directed towards the interior of boiler body sucked by fan 17.

FIG. 4, shows wall 7 of the boiler body comprising mixing and ignition unit 4, which has a lid 22 openable for the inspection of the injection nozzle 4*a* and its possible maintenance.

Figure 6:
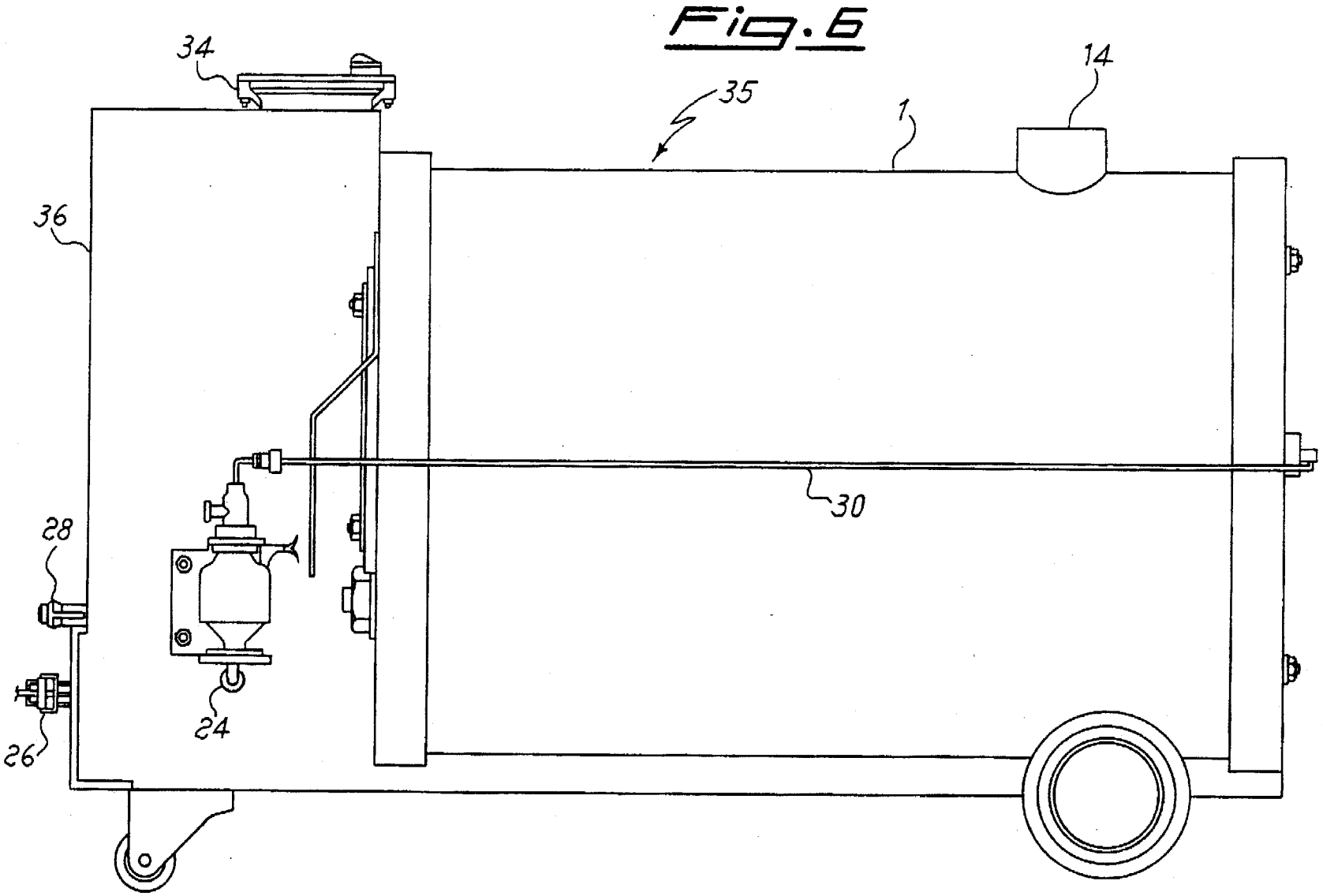
FIG. 6 is the schematic side view of the boiler of this invention, applied to a wheeled frame.

FIG. 6 shows the boiler of this invention utilized by way of example for hydrocleaning machine 35 mounted on a wheeled cart 36.

For the sake of completeness there are also shown: a solenoid pump 24 supplying pressurized fluid to mixing and ignition unit 4 of the boiler through a pipe 30 running along the side of boiler 1, spouts 26, 28 for the exit of steam from the hydrocleaning machine and an ignition device 14 for ignition unit 4 and is located on the upper part of the frame of the hydrocleaning machine.

From the above detailed description the advantages achieved by the invention are evident.

First of all, the fan system, as arranged, generates an air flow in air gap 18 formed between cylinder 10 external to the combustion chamber and external box 12, providing basic advantages.

The temperature of air increases in the air gap, due to pipe 8 wrapped up around combustion chamber 6 and containing hot water, so that the quality of combustion improves which leads to a higher yield of the boiler.

Besides the air flow, the temperature of which is markedly lower than cylinder 10 external to the combustion chamber, creates in the air gap 18 a heat insulating layer between the cylinder 10 and the external container 12, keeping the external container at a low temperature and preventing useless heat loss in the surrounding environment.

Finally, the low values of the temperature of the external box 12 is a safety guarantee for the users of the apparatus which is used with the boiler.

Thanks to its structure as defined above, the boiler can be easily fixed on wheeled carts, either horizontally or possibly vertically. This is made possible as ventilation is forced and the air flow remains always constant independently of the position of the boiler. Consequently, the drawbacks associated to the great overall dimensions of traditional boilers, which are often equipped with bulky components that protrude from the boiler body and limit its handling, are eliminated.

While the invention has been described with reference to a specific embodiment by way of example, it is obvious that the variations and alternatives made to the same will be clear to those skilled in the art, in the light of the above description.

The invention intends therefore to comprise all the alternatives and variations falling within the spirit and scope of the claims.

I claim:

1. A monobloc boiler for hydrocleaning machines, said boiler having a body comprising a cylindrical external box (12), said cylindrical external box having an inner wall, a first rear wall (9) and a second wall (7) opposite to the first wall (9), said second wall (7) having a central part, said cylindrical external box being provided with a chimney (14) for the exit of exhaust smoke, said external box (12) including in the interior thereof: a cylindrical combustion chamber (6), said chamber (6) having an interior and being externally provided with a cylindrical double coil pipe (8) wherein water to be heated flows, wrapped up on said chamber; an external cylinder (10) wrapping said combustion chamber; a fuel mixing and ignition unit (4) located in the interior of said combustion chamber (6) and fixed to said central part of said second wall, a fan system (16) for the inlet of air into said boiler body, located in the interior of said boiler body and fixed on said first rear wall (9) of said external box (12), an air gap (18) being formed between said external container (12) and said cylinder (10), said fan system generating an air flow in said air gap (18), said air gap being external to said combustion chamber (6), and means (5) for air distribution and braking radially arranged in said air gap (18) and fixed to said inner wall of box (12) said means (5) being constituted by L-shaped brackets radially arranged in said air gap (18) and connected to said inner wall of said cylindrical external box (12).

2. The monobloc boiler of claim 1, wherein said fuel mixing and ignition unit (4) is constituted by an injection nozzle (4*a*) fixed to said second rear wall (7) of said external box (12); a mixing baffle (4*b*) and a pipe union (4*c*), fixed both on said cylinder (10) external to combustion chamber (6).

3. The monobloc boiler according to claim 2 wherein said injection nozzle (4*a*) is closed by an openable lid (22), said unit (4) having an exterior, said lid permitting access to said nozzle from the exterior of said unit (4).

4. The monobloc boiler of claim 1 wherein said fan system (16) is constituted by a fan (17) and a scroll (19) for air inlet into said air gap (18).

5. The monobloc boiler according to claim 4 wherein said fan (17) is activated by a motor-driven pump (40), said pump also providing for water circulation in said pipes (8).

6. The boiler according to claim 5 wherein said motor-driven pump (40) has a shaft, said shaft being also the shaft of said fan (17).

7. The monobloc boiler according to claim 4, wherein said first rear wall has an external part and an angular diaphragm (20) is located on said external part of said first rear wall (9) of box (12), said diaphragm determining the quantity of air directed towards the interior of said boiler body sucked by fan (17).

8. The monobloc boiler according to claim 1 which is fixed in the horizontal position on a wheeled cart (36).

9. The monobloc boiler of claim 8, in combination with a hydrocleaning machine (35), said machine being mounted on said wheeled cart (36), wherein pressurized fuel is supplied to said mixing and ignition unit (4) by a solenoid pump (24) through a pipe (30) running alongside said boiler.

* * * * *